United States Patent [19]

Sparling

[11] Patent Number: 4,993,685

[45] Date of Patent: Feb. 19, 1991

[54] AUTOMOTIVE RAMP APPARATUS

[76] Inventor: Danny E. Sparling, 2401 Grandview #32, Casper, Wyo. 82601

[21] Appl. No.: 529,531

[22] Filed: May 29, 1990

[51] Int. Cl.[5] ..... B66F 19/00; E02C 3/00

[52] U.S. Cl. ..... 254/88

[58] Field of Search ..... 254/88; 14/69.5, 71.1; 248/188.2, 346, 352

[56] References Cited

U.S. PATENT DOCUMENTS

| | | | |
|---|---|---|---|
| 1,271,584 | 7/1918 | Klemme | 254/88 |
| 1,457,028 | 5/1923 | Harvey | 254/88 |
| 1,510,209 | 9/1924 | Christman | 254/88 |
| 1,871,129 | 8/1932 | Pierce | 254/88 |
| 2,420,130 | 6/1947 | Foss | 254/88 |
| 3,990,681 | 11/1976 | McKeen | 254/88 |
| 4,238,114 | 12/1980 | Migliorati | 254/88 |
| 4,327,896 | 5/1982 | Whitehead | 254/88 |

*Primary Examiner*—Robert C. Watson

*Attorney, Agent, or Firm*—Leon Gilden

[57] ABSTRACT

Apparatus including spaced ramps directing spaced wheels of an automobile upon platforms to define each of the first and second ramp members. An elongate flexible web is mounted longitudinally of each ramp member and extends forwardly thereof to accommodate frictional engagement with automotive wheels to align and secure the ramps in position subject to mounting of the ramps by the associated automobile.

3 Claims, 4 Drawing Sheets

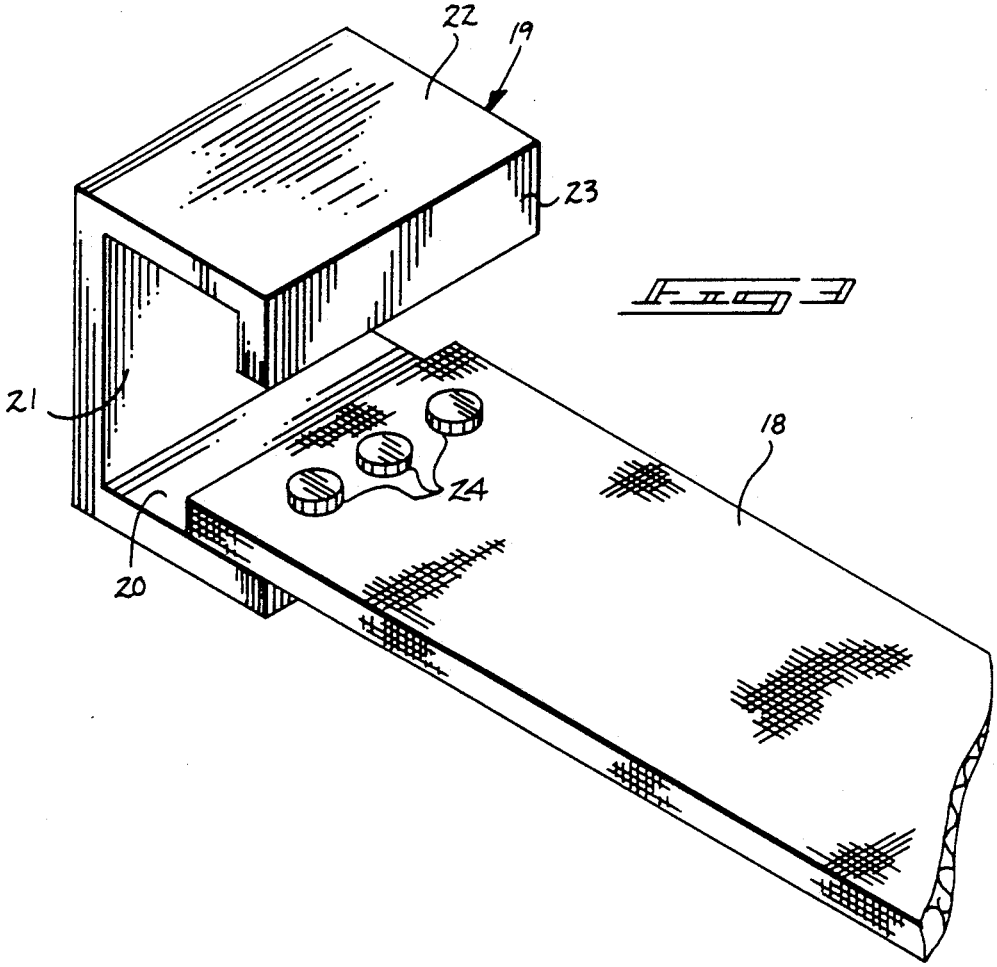
Fig 3
Fig 4
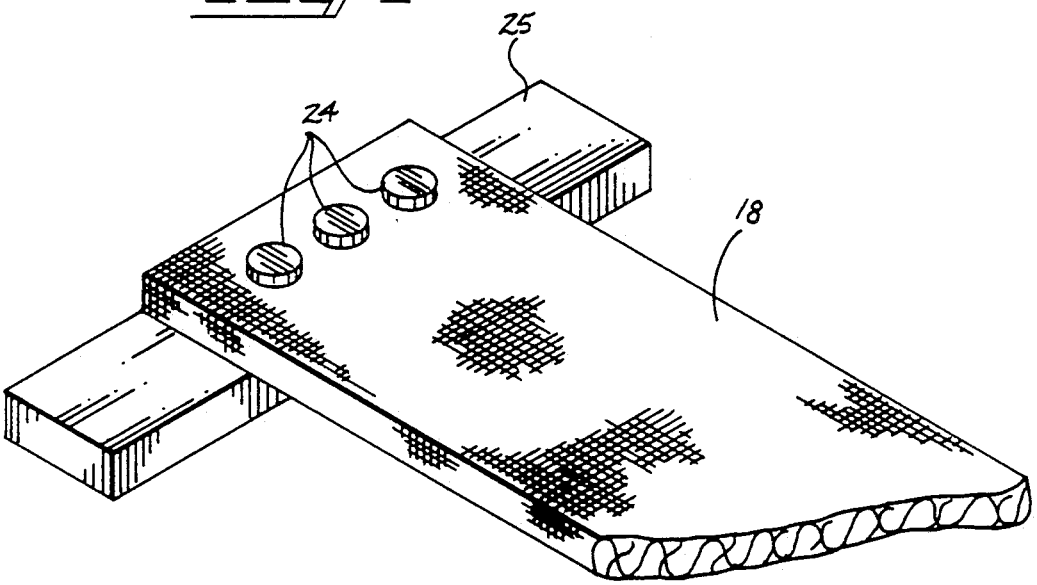

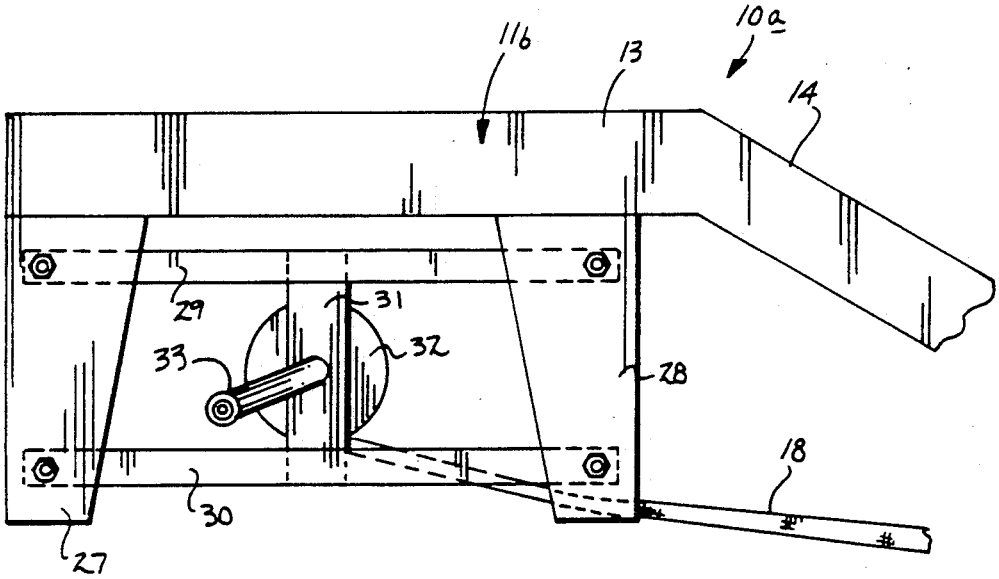
FIG 7
FIG 8
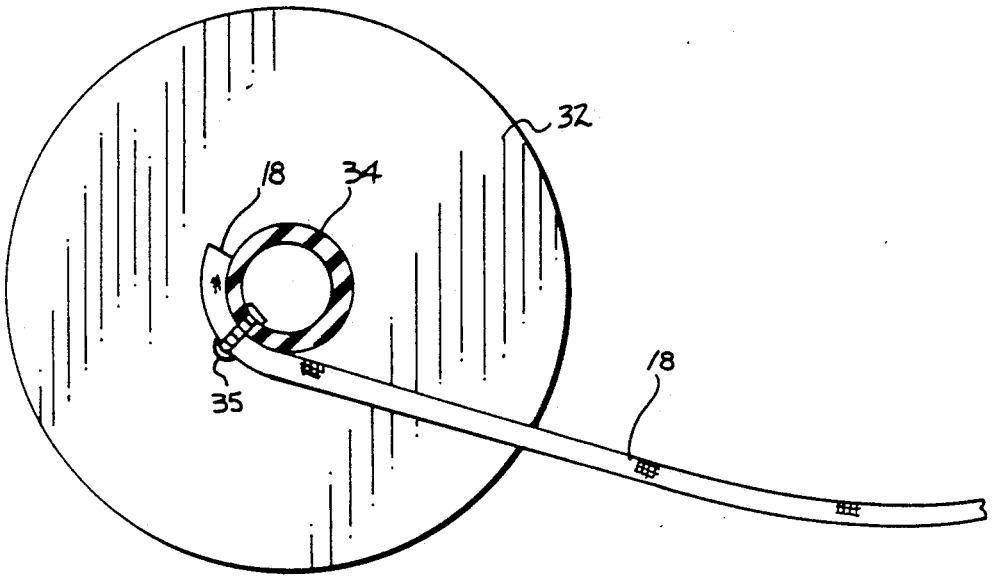

AUTOMOTIVE RAMP APPARATUS

BACKGROUND OF THE INVENTION

1. Field of the invention

The field of the invention relates to automotive ramp structure, and more particularly pertains to a new and improved automotive ramp apparatus wherein the same utilizes elongate flexible webs in association with rearwardly positioned ramps to align the ramp members in association with an automobile.

2. Description of the Prior Art

In leu of the use of lifting jacks to lift an automotive forward or rear portion upwardly, ramp structures are utilized that permits elevation of the automobile body through its wheels. Each of a plurality of ramps are arranged to provide support for the spaced wheels of the automobile in use. Examples of the prior art structure may be found in U.S. Pat. No. 1,904,693 to MYERS et al wherein a interfolding ramp is provided with an upper platform and a forwardly positioned ramp member.

U.S. Pat. No. 2,279,464 to JACKSON sets forth a ramp structure for use with automobiles wherein the support portion of the ramps are provided with a recessed area to anchor an automobile in use.

U.S. Pat. No. 2,232,585 to ALDRICH sets forth an automobile wheel support structure utilizing an arcuate support in association with a forwardly positioned ramp to support spaced wheels of an automobile.

U.S. Pat. No. 3,638,910 to NELLIS et al sets forth a ramp structure easily disassembled for storage during periods of non-use.

U.S. Pat. No. 3,847,376 to BINDING sets forth a portable vehicular ramp and rack structure utilizing traction surface portions associated with the ramp and support to maintain the automobile in orientation relative to the ramp structure in use.

As such, it may be appreciated that there continues to be a need for a new and improved automotive ramp apparatus as set forth by the instant invention wherein the same addresses both the problems of ease of use as well as safety and effectiveness in construction to fixedly secure the ramps in orientation with mounting wheels of an automobile to prevent misalignment of the ramps during use and mounting by the automobile.

SUMMARY OF THE INVENTION

In view of the foregoing disadvantages inherent in the known types of automotive ramp structure present in the prior art, the present invention provides a new and improved automotive ramp apparatus wherein the same utilize a plurality of spaced automotive ramp members each including a flexible web underlying each of the ramp members and extending forwardly thereof to permit mounting of the webs by automotive tires and maintain alignment of the ramp members for subsequent mounting of the ramp members by the automobile. As such, the general purpose of the present invention, which will be described subsequently in greater detail, is to provide a new and improved automotive ramp apparatus which has all the advantages of the prior art automotive ramp structure and none of the disadvantages.

To attain this, the automotive ramp apparatus of the invention includes apparatus including spaced ramps directing spaced wheels of an automobile upon platforms to define each of the first and second ramp members. An elongate flexible web is mounted longitudinally of each ramp member and extends forwardly thereof to accommodate frictional engagement with automotive wheels to align and secure the ramps in position subject to mounting of the ramps by the associated automobile.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved automotive ramp apparatus which has all the advantages of the prior art automotive ramp apparatus and none of the disadvantages.

It is another object of the present invention to provide a new and improved automotive ramp apparatus which may be easily and efficiently manufactured and marketed.

It is a further object of the present invention to provide a new and improved automotive ramp apparatus which is of a durable and reliable construction.

An even further object of the present invention is to provide a new and improved automotive ramp apparatus which is susceptible of a low cost of manufacture with regard to both materials and labor, and which accordingly is then susceptible of low prices of sale to the consuming public, thereby making such automotive ramp apparatus economically available to the buying public.

Still yet another object of the present invention is to provide a new and improved automotive ramp apparatus which provides in the apparatuses and methods of the prior art some of the advantages thereof, while simultaneously overcoming some of the disadvantages normally associated therewith.

Still another object of the present invention is to provide a new and improved automotive ramp apparatus which may be compactly stored when not being utilized.

Yet another object of the present invention is to provide a new and improved automotive ramp apparatus wherein the same aligns and secures an automobile relative to spaced ramps to enhance ease of mounting and insure alignment of the ramp members in association with the automobile.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of a mounting association of the flexible web structure in use with the ramp members of the instant invention.

FIG. 4 is an isometric illustration of a further web mounting structure relative to the ramp members of the instant invention.

FIG. 7 is an orthographic side view taken in elevation of a modified ramp structure utilized by the instant invention.

FIG. 8 is an orthographic cross-sectional view of a winding drum utilized by the instant invention as set forth in FIG. 7.

DESCRIPTION OF THE PREFERRED EMBODIMENT

Figure 1:
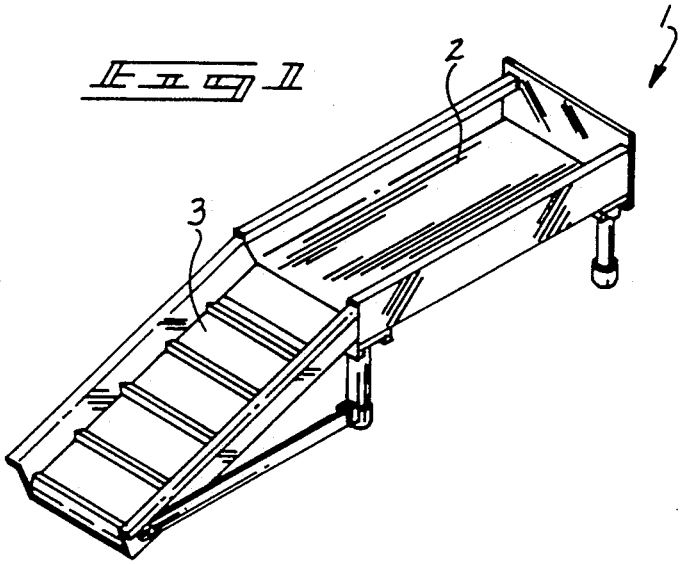
FIG. 1 is an isometric illustration of a prior art automotive ramp apparatus.

With reference now to the drawings, and in particular to FIGS. 1 to 8 thereof, a new and improved automotive ramp apparatus embodying the principles and concepts of the present invention and generally designated by the reference numerals 10 and 10*a* will be described.

FIG. 1 illustrates a prior art automotive ramp structure 1 utilizing a typical platform 2 and a ramp 3 mounted forwardly thereof to receive an automotive wheel of an automobile therewithin. Typically such ramp members are utilized in pairs.

More specifically, the automotive ramp apparatus 10 of the instant invention essentially comprises a first ramp member 11 spaced from and parallel to a second ramp member 12 utilized in pairs of identical construction relative to one another. For purposes of disclosure, only one of the ramp members 11 and 12 need be described herewithin. Each ramp member is formed to include a platform 13 of a generally horizontal orientation with a ramp member 14 fixedly mounted to a forward terminal end of each platform member 13 longitudinally aligned therewith and directed downwardly therefrom. Each ramp member 14 includes a forward edge 14*a* spaced below the associated platform member 13. The platform member 13 includes a rear vertical support 15 and a forward vertical support 16 directed orthogonally and downwardly relative to each platform member 13 with side rails 17 longitudinally and coextensively formed with the first and second ramp members 11 and 12 on opposite sides thereof fixedly mounted to lower terminal ends of the rear and forward vertical supports 15 and 16 as well as the ramp member 14 adjacent the forward edge 14*a*. The side rails 17 are generally parallel relative to one another and as illustrated, the platform member 13 and the ramp member 14 are longitudinally aligned relative to one another in use.

A flexible web 18 is mounted underlying each ramp member and projecting forwardly of each forward terminal edge 14*a* of each ramp member 14 and extending forwardly of each ramp member 14 longitudinally aligned therewith.

Figure 2:
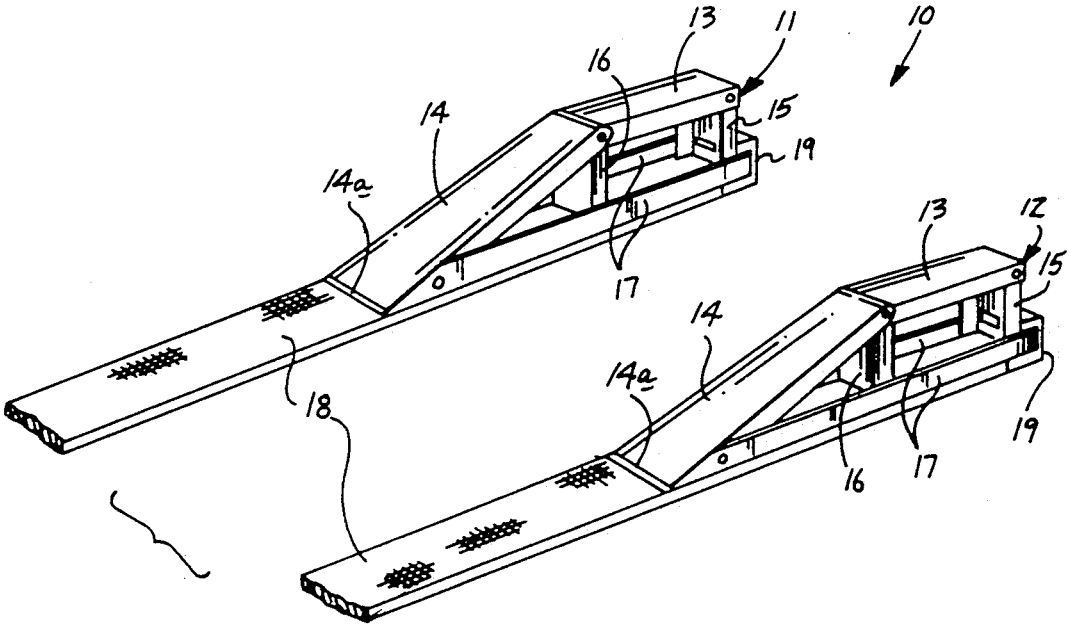
PRIOR ART FIG 2
FIG. 2 is an isometric illustration of the instant invention.
Figure 5:
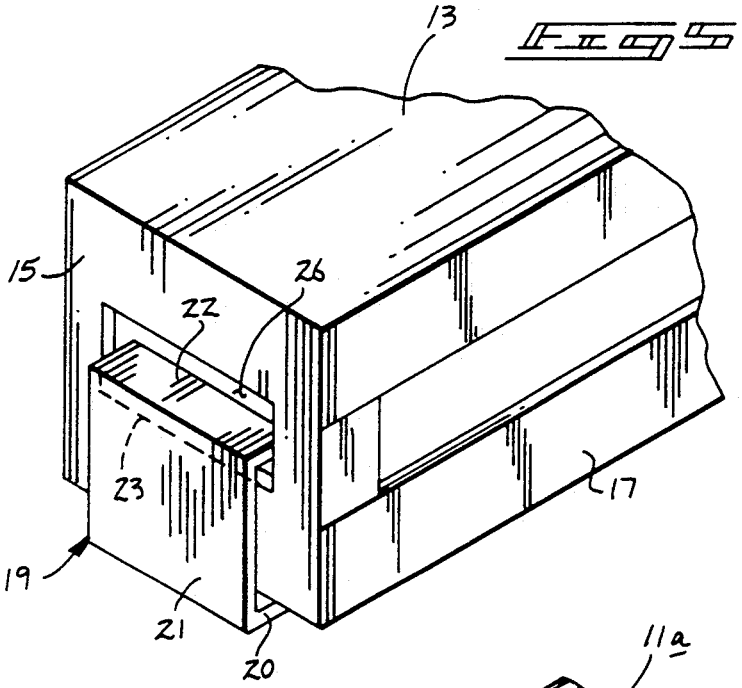
FIG. 5 is an isometric rear illustration of the mounting structure of FIG. 3 in association with a ramp member.

The flexible web 13 as illustrated in FIGS. 2 and 3 mounted fixedly to a C-shaped mounting block 19. The C-shaped mounting block includes a bottom horizontal plate 20, a rear vertical plate 21 orthogonally and integrally mounted to the bottom horizontal support plate 20 with a top horizontal plate 22 overlying the bottom horizontal plate 20 parallel thereto and includes an engagement flange 23 directed orthogonally and downwardly relative to a forward edge of the top horizontal plate 22. The engagement flange 23 is received within a slot 26 (see FIG. 5) to secure in a releasable manner the C-shaped mounting block 19 therewithin. The flexible web 18 is fixedly mounted overlying the bottom horizontal support plate 20 utilizing a series of fasteners 24 to secure the flexible web thereto. The slot 26 is directed through the rear vertical support 15 and is spaced above a lower terminal edge of the rear vertical support 15 a predetermined distance substantially equal to the rear vertical plate 21 to accommodate the flange 23 within the slot with the rear vertical plate 21 mounted adjacent and in contiguous relationship with the rear vertical support 15 when the C-shaped mounting block 19 is mounted to the rear vertical support 15 as illustrated in FIG. 5.

FIG. 4 illustrates an alternative manner of securing the flexible web 18 to the rear vertical support 15 wherein the rear vertical support 15 includes a plurality of spaced rear support legs 27. The support legs 27 include a spanning rear frame plate 25 orthogonally directed between each of the support legs 27 with the flexible web 18 mounted to the rear frame plate 25 by a series of fasteners 24. In this manner, the flexible web 18 is mounted to the framework of each ramp member 11 and 12 in a manner to fixedly secure each flexible web 18 thereto and longitudinally align each flexible web with the first and second ramp members 11 and 12 as illustrated in FIG. 2.

Figure 6:
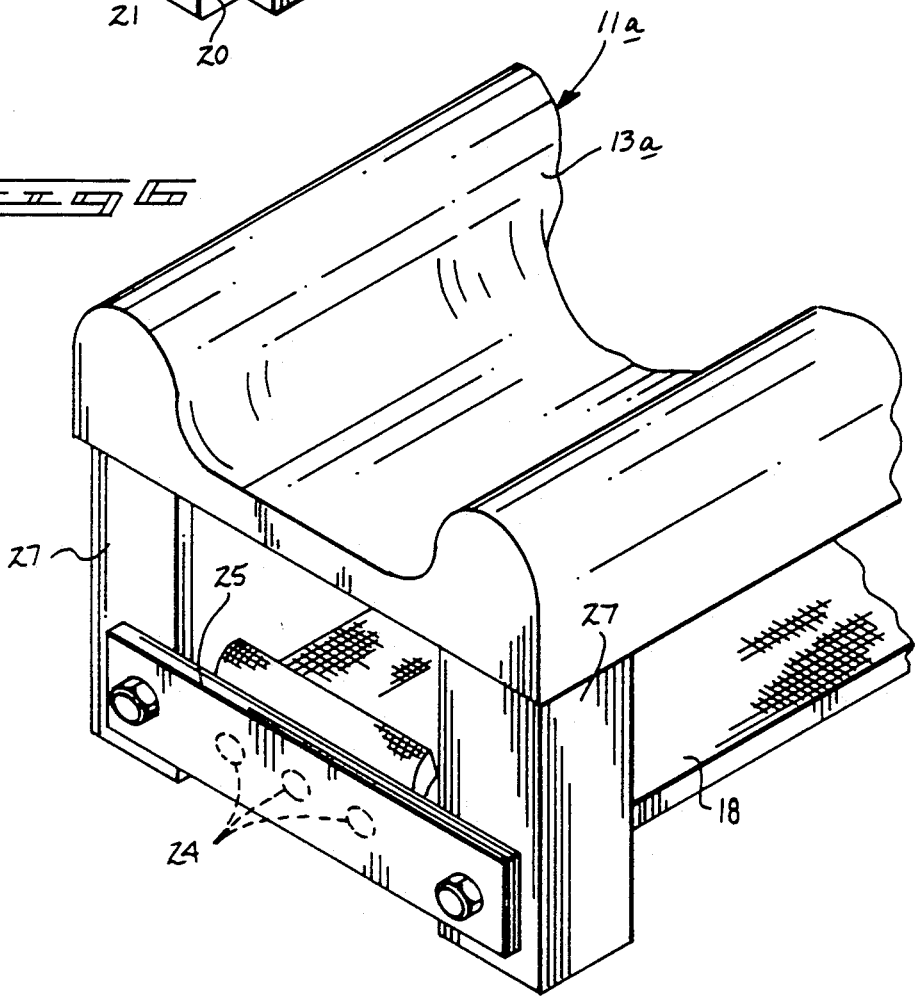
FIG. 6 is a rear isometric illustration of the flexible web mounting structure of FIG. 4 in association with a ramp member.

FIG. 7 illustrates a modification 10*a* of the automotive ramp apparatus wherein the ramp member 14 is mounted to the platform member 13 in a manner as discussed above including the rear vertical support 15 and the forward vertical support 16 defined as spaced rear and forward support legs 27 and 28 in a manner as illustrated in FIG. 6 for example. A top and bottom parallel bar 29 or 30 are mounted fixedly between the spaced rear and forward support legs 27 and 28 including a vertical support bar 31 mounted therebetween. A winding and reeling drum 32 is mounted medially of the vertical support bar 31 including a handle 33 mounted to the drum 32 to effect a winding of the flexible web 18 mounted to the drum axle 34 (see FIG. 8). The drum axle 34 includes a fastener 35 directed adjacent a rear terminal end edge of the flexible web 18 and through the axle 34 to secure the flexible web 18 to the drum 32. In this manner, the flexible web 18 may be retracted subsequent to use to provide storage of the flexible web. It should be noted that the flexible web 18 is directed between the spaced forward support legs 28 and is received therebetween to permit retraction of the web 18.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An automotive ramp apparatus comprising, a horizontal platform member, the horizontal platform member including a rear terminal end and a forward terminal end, and a ramp member, the ramp member fixedly mounted to the platform member at the forward terminal end defining an intersection with the ramp member longitudinally aligned to the platform member and directed downwardly therefrom wherein the ramp member includes a ramp member forward terminal edge disposed generally orthogonally to the ramp member spaced below the platform member, and a rear vertical support orthogonally mounted underlying the platform member at the rear terminal end, and a forward vertical support orthogonally mounted to the platform member at the intersection, the rear and forward vertical supports including spaced parallel side rails to secure the rear and forward vertical supports together, the side rails arranged parallel relative to one another, and the rear vertical support, the forward vertical support, and the side rails defining a framework underlying the platform member, and an elongate longitudinally aligned flexible web mounted to the framework, the flexible web extending longitudinally of and forwardly of the ramp member forward terminal edge underlying the ramp member forward terminal edge to frictionally accommodate an automotive wheel mounted thereon to align and secure the ramp member to the automotive wheel, and the flexible web includes a rear terminal edge, the rear terminal edge mounted to a "C" shaped mounting block, the "C" shaped mounting block including a bottom horizontal plate, a top horizontal plate overlying and parallel to the bottom horizontal plate, and a rear vertical plate mounted orthogonally between the top and bottom horizontal plates, and an engagement flange integrally and downwardly mounted to a forward elongate edge of the top horizontal plate, the rear vertical support including a slot, and the engagement flange directed through the slot to secure the flexible web to the framework.

2. Apparatus as set forth in claim 1 wherein the rear vertical plate is defined by a predetermined height, and the slot is spaced above a bottom edge of the rear vertical support the predetermined height to accommodate the engagement flange through the slot and permit securement of the engagement flange within the slot and arrange the bottom horizontal plate underlying the rear vertical support to align the flexible web longitudinally with the at least one ramp member.

3. Apparatus as set forth in claim 1 wherein the rear vertical support includes spaced rear support legs, and the forward vertical support includes spaced forward support legs, and a top bar orthogonally mounted between the rear and forward support legs, and a bottom bar parallel to and underlying the top bar integrally and orthogonally mounted to the rear and forward support legs, and the bottom bar spaced above lower terminal support edges defined by the rear and forward support legs, and a vertical support bar integrally and orthogonally mounted between the top and bottom bar, and a winding and reeling drum orthogonally mounted to the vertical support bar, and a handle mounted to the winding and reeling drum, and the flexible web including a rear terminal edge, and the drum including a drum axle, and at least one fastener securing the flexible web adjacent the rear terminal edge of the flexible web to the drum axle.

* * * * *